US008662830B2

(12) United States Patent
Sankolli et al.

(10) Patent No.: US 8,662,830 B2
(45) Date of Patent: Mar. 4, 2014

(54) ADJUSTABLE SUPPORT APPARATUS FOR STEAM TURBINE NOZZLE ASSEMBLY

(75) Inventors: Prashant Prabhakar Sankolli, Bangalore (IN); James Peter Anderson, Clifton Park, NY (US); Jason Paul Mortzheim, Gloversville, NY (US)

(73) Assignee: General Electric Company, Schenectady, NY (US)

( * ) Notice: Subject to any disclaimer, the term of this patent is extended or adjusted under 35 U.S.C. 154(b) by 909 days.

(21) Appl. No.: 12/813,711

(22) Filed: Jun. 11, 2010

(65) Prior Publication Data

US 2011/0305566 A1 Dec. 15, 2011

(51) Int. Cl.
*F01D 25/24* (2006.01)
*F04D 29/40* (2006.01)

(52) U.S. Cl.
USPC ..... 415/126; 415/209.2

(58) Field of Classification Search
USPC ..... 415/209.2, 213.1, 214.1, 220, 126, 127
See application file for complete search history.

(56) References Cited

U.S. PATENT DOCUMENTS

| | | | | |
|---|---|---|---|---|
| 3,861,827 | A * | 1/1975 | Peabody et al. | 415/209.2 |
| 4,204,803 | A * | 5/1980 | Leger et al. | 415/209.2 |
| 5,393,145 | A * | 2/1995 | Ide | 384/124 |
| 6,325,596 | B1 | 12/2001 | Tomko | |
| 6,352,405 | B1 * | 3/2002 | Tomko | 415/209.2 |
| 6,547,523 | B2 | 4/2003 | Nelligan | |
| 7,329,098 | B2 | 2/2008 | Burdgick | |
| 7,396,203 | B2 * | 7/2008 | Martindale | 415/136 |
| 7,419,355 | B2 * | 9/2008 | Burdgick | 415/213.1 |
| 7,458,770 | B2 * | 12/2008 | Russo et al. | 415/126 |
| 8,414,258 | B2 * | 4/2013 | Burdgick et al. | 415/209.2 |
| 2012/0114470 | A1 * | 5/2012 | Burdgick | 415/201 |

* cited by examiner

*Primary Examiner* — Nathaniel Wiehe
*Assistant Examiner* — Su Htay
(74) *Attorney, Agent, or Firm* — Hoffman Warnick LLC; Ernest G. Cusick

(57) ABSTRACT

An adjustable support apparatus for a steam turbine nozzle assembly is disclosed. In one embodiment, a steam turbine apparatus includes: a diaphragm segment having a horizontal joint surface and an angled ledge below the horizontal joint surface, the angled ledge configured to receive a complementary angled portion of a wedge member.

16 Claims, 7 Drawing Sheets

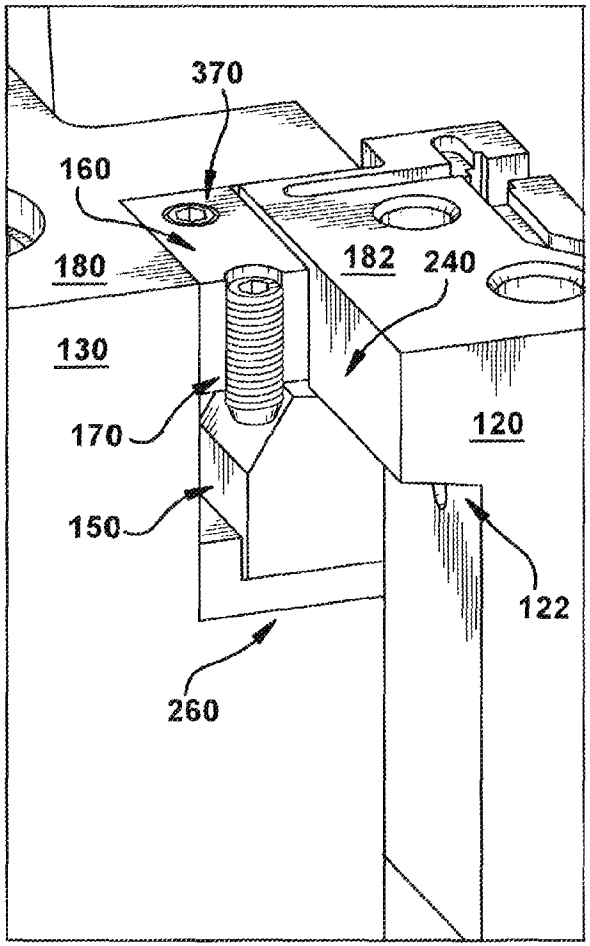
FIG. 6
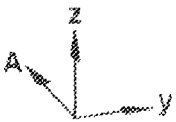

ADJUSTABLE SUPPORT APPARATUS FOR STEAM TURBINE NOZZLE ASSEMBLY

BACKGROUND OF THE INVENTION

The subject matter disclosed herein relates to a steam turbine nozzle assembly, or diaphragm stage. Specifically, the subject matter disclosed herein relates to an adjustable support apparatus for a steam turbine nozzle assembly.

Steam turbines include static nozzle assemblies that direct flow of a working fluid into turbine buckets connected to a rotating rotor. The nozzle construction (including a plurality of nozzles, or "airfoils") is sometimes referred to as a "diaphragm" or "nozzle assembly stage." Steam turbine diaphragms include two halves, which are assembled around the rotor, creating horizontal joints between these two halves. Each turbine diaphragm stage is vertically supported by support bars, support lugs or support screws on each side of the diaphragm at the respective horizontal joints. The horizontal joints of the diaphragm also correspond to horizontal joints of the turbine casing, which surrounds the steam turbine diaphragm.

Support bars are typically attached horizontally to the bottom half of the diaphragm stage near the horizontal joints by bolts. The typical support bar includes a tongue portion that fits into a pocket which is machined into the diaphragm. This support bar also includes an elongated portion which sits on a ledge of the turbine casing. Performing diaphragm maintenance may require accessing the bottom half of the diaphragm, which is incapable of rotating about the turbine rotor due to the support bars and a centering pin that couples the bottom half of diaphragm to the casing. Additionally, removal of the bottom half of the diaphragm may also be necessary in order to align the bottom half with the horizontal joint of the casing. In order to access the bottom half of the diaphragm, a number of time-consuming and costly steps could be undertaken.

BRIEF DESCRIPTION OF THE INVENTION

An adjustable steam turbine nozzle support apparatus is disclosed. In one embodiment, a steam turbine apparatus includes: a casing segment; a diaphragm segment at least partially housed within the casing segment; and an adjustable support apparatus between the casing segment and the diaphragm segment, the adjustable support apparatus including: a wedge member contacting the casing segment and the diaphragm segment; a support member; and an adjustment member in contact with the wedge member and the support member.

A first aspect of the invention includes a steam turbine apparatus comprising: a casing segment; a diaphragm segment at least partially housed within the casing segment; and an adjustable support apparatus between the casing segment and the diaphragm segment, the adjustable support apparatus including: a wedge member contacting the casing segment and the diaphragm segment; a support member; and an adjustment member in contact with the wedge member and the support member.

A second aspect of the invention includes a steam turbine apparatus comprising: a casing having a horizontal joint surface; a rotor within the casing; a diaphragm segment at least partially housed within the casing; and an adjustable support apparatus between the casing segment and the diaphragm segment, the adjustable support apparatus including: a wedge member contacting the casing segment and the diaphragm segment; a support member having an aperture extending at least partially therethrough; and an adjustment member in contact with the wedge member and at least partially located within the aperture of the support member; wherein the adjustment member is configured to adjust a position of the wedge member from a location above the horizontal joint surface.

A third aspect of the invention includes a steam turbine apparatus comprising: a diaphragm segment having a horizontal joint surface and an angled ledge below the horizontal joint surface, the angled ledge configured to receive a complementary angled portion of a wedge member.

BRIEF DESCRIPTION OF THE DRAWINGS

These and other features of this invention will be more readily understood from the following detailed description of the various aspects of the invention taken in conjunction with the accompanying drawings that depict various embodiments of the invention.

FIG. 6 shows a three-dimensional perspective view of a partial end elevation of a steam turbine apparatus according to an embodiment of the invention.

It is noted that the drawings of the invention are not to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

Aspects of the invention provide for an adjustable support apparatus for a steam turbine nozzle assembly. In one embodiment, this adjustable support apparatus may include a wedge member, a support member and an adjustment member, for adjusting the relative position of a steam turbine casing and a steam turbine diaphragm. Another aspect of the invention provides for a lower diaphragm segment of a steam turbine having a horizontal joint surface and an angled ledge below the horizontal joint surface. The angled ledge may be configured to receive a complementary angled portion of the wedge member.

Figure 1:
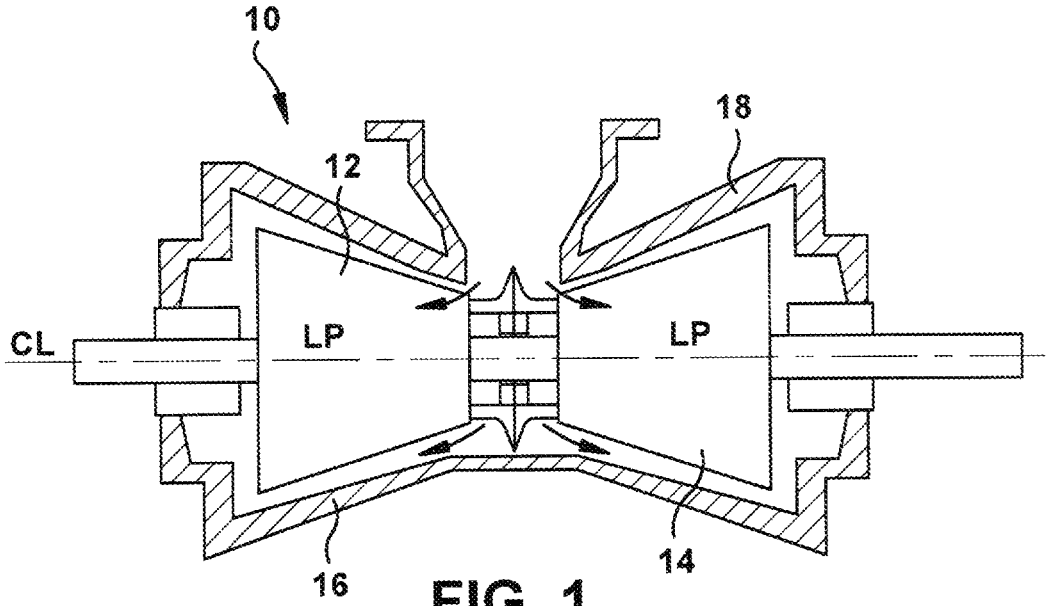
FIG. 1 (Prior Art)
FIG. 1 shows a partial cross-sectional schematic of a double-flow steam turbine according to the prior art.
Figure 2:
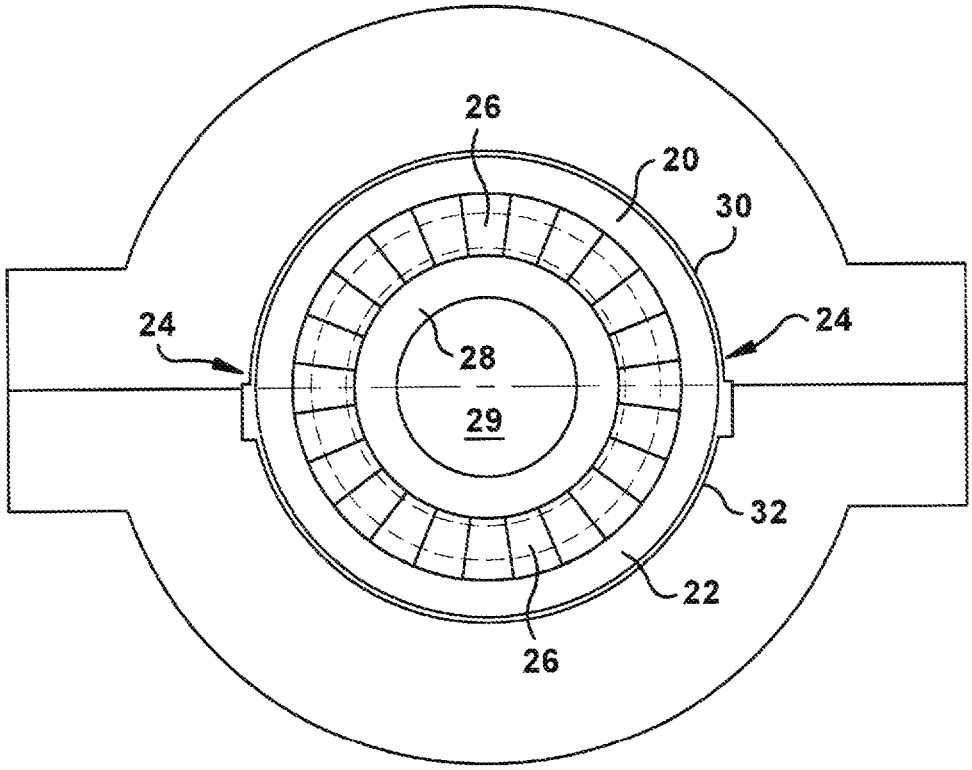
FIG. 2 (Prior Art)
FIG. 2 shows a general schematic end elevation of a pair of annular diaphragm ring segments joined at a horizontal split surface according to the prior art.

Turning to FIG. 1, a partial cross-sectional schematic of a double-flow steam turbine 10 (e.g., a low-pressure steam turbine) according to the prior art is shown. Double-flow steam turbine 10 may include a first low-pressure (LP) section 12 and a second LP section 14, surrounded by first and second diaphragm assemblies 16, 18, respectively (including casing sections and diaphragm ring segments housed therein). As shown in FIG. 2, each diaphragm assembly 16, 18 includes a pair of semi-annular diaphragm ring segments 20, 22, which are joined at a horizontal joint surface 24. Diaphragm ring segments 20, 22 are housed within casing segments 30, 32, respectively, which are also joined at horizontal joint surface 24. Each semi-annular diaphragm ring segment 20, 22, supports a semi-annular row of turbine nozzles 26 and an inner web 28, as is known in the art. The diaphragm ring segments 20, 22 collectively surround a rotor 29 (shown in phantom), as is known in the art.

Figure 3:
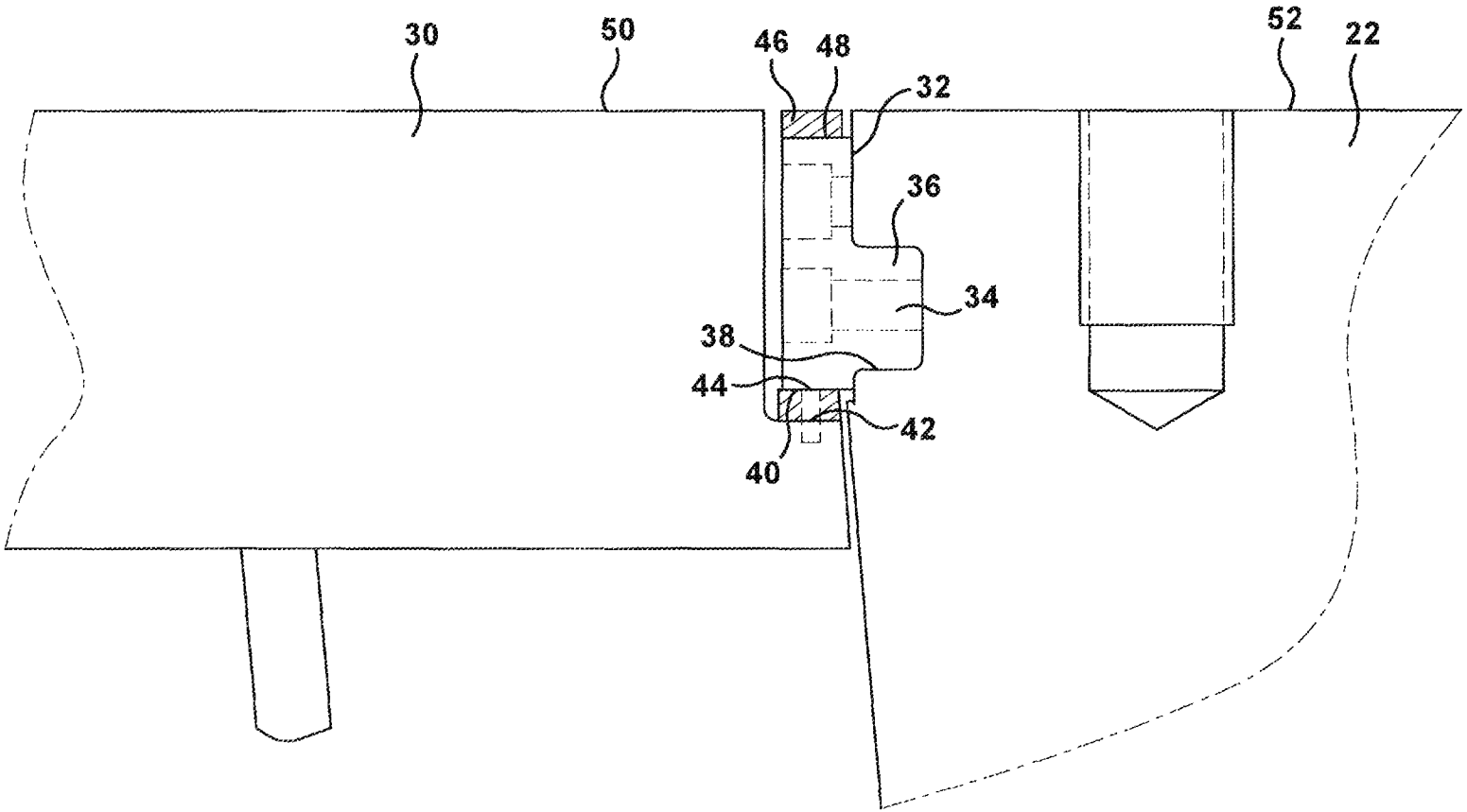
FIG. 3 (Prior Art)
FIG. 3 shows a partial end elevation of a steam turbine nozzle support assembly according to the prior art.

Turning to FIG. 3, a prior art support assembly for a steam turbine diaphragm is shown. Specifically, FIG. 3 shows a close-up view of a portion of the lower semi-annular diaphragm ring segment (or simply, lower diaphragm segment) 22 of FIG. 2, which is affixedly coupled to a lower turbine casing half (or simply, casing) 30. Lower diaphragm segment 22 is shown to be vertically supported within casing 30 by a support bar 32, as is known in the art. Support bar 32 is bolted to lower diaphragm segment 22 by bolt(s) 34 extending through support bar 32. At least one bolt 34 may extend through a radially inwardly directed flange 36 of support bar 32. Flange 36 is received in a mating slot 38 in lower diaphragm segment 22. Support bar 32 otherwise extends vertically along casing 30 on one side and diaphragm segment 22 on the other side. A lower surface 40 of the support bar faces a shoulder 42 formed in casing 30, with a shim block (or simply, shim) 44 interposed between shoulder 42 and lower surface 40. Shim 44 is typically bolted to casing 30. A second shim block 46 is shown seated on an upper surface 48 of support bar 32 to effectively make the upper end of support bar flush with horizontal joint surfaces 50, 52 of casing 30 and lower diaphragm segment 22, respectively. This arrangement allows support bar 32 to be sandwiched between the upper and lower casing sections (upper casing omitted). The other side of lower diaphragm segment 22 is similarly supported on the opposite side of the casing (other side omitted for clarity).

Performing vertical diaphragm alignment (alignment of horizontal joint surfaces 50, 52) or performing maintenance on diaphragm segment 22 (and components included therein) requires removal of the upper half of the casing, along with upper diaphragm segment 20 (FIG. 2). Further, because support bar 32 couples lower diaphragm segment 22 to casing 30, and due to the presence of a centering pin (not shown) coupling the diaphragm to the casing, lower diaphragm segment 22 cannot be rotated around rotor 29 (FIG. 2) while housed within casing 30 (due to a lack of clearance). Due to this limited clearance, the positioning of bolts 34 in support bars 32, and the presence of the centering pin, the lower diaphragm segment 22 must be removed vertically from casing 30 in order to access support bars 32 and align diaphragm segment 22 with casing 30. This requires removing rotor 29, and subsequently lifting lower diaphragm segment 22 vertically in order to remove bolts 34. This process is both time consuming and costly.

Figure 4:
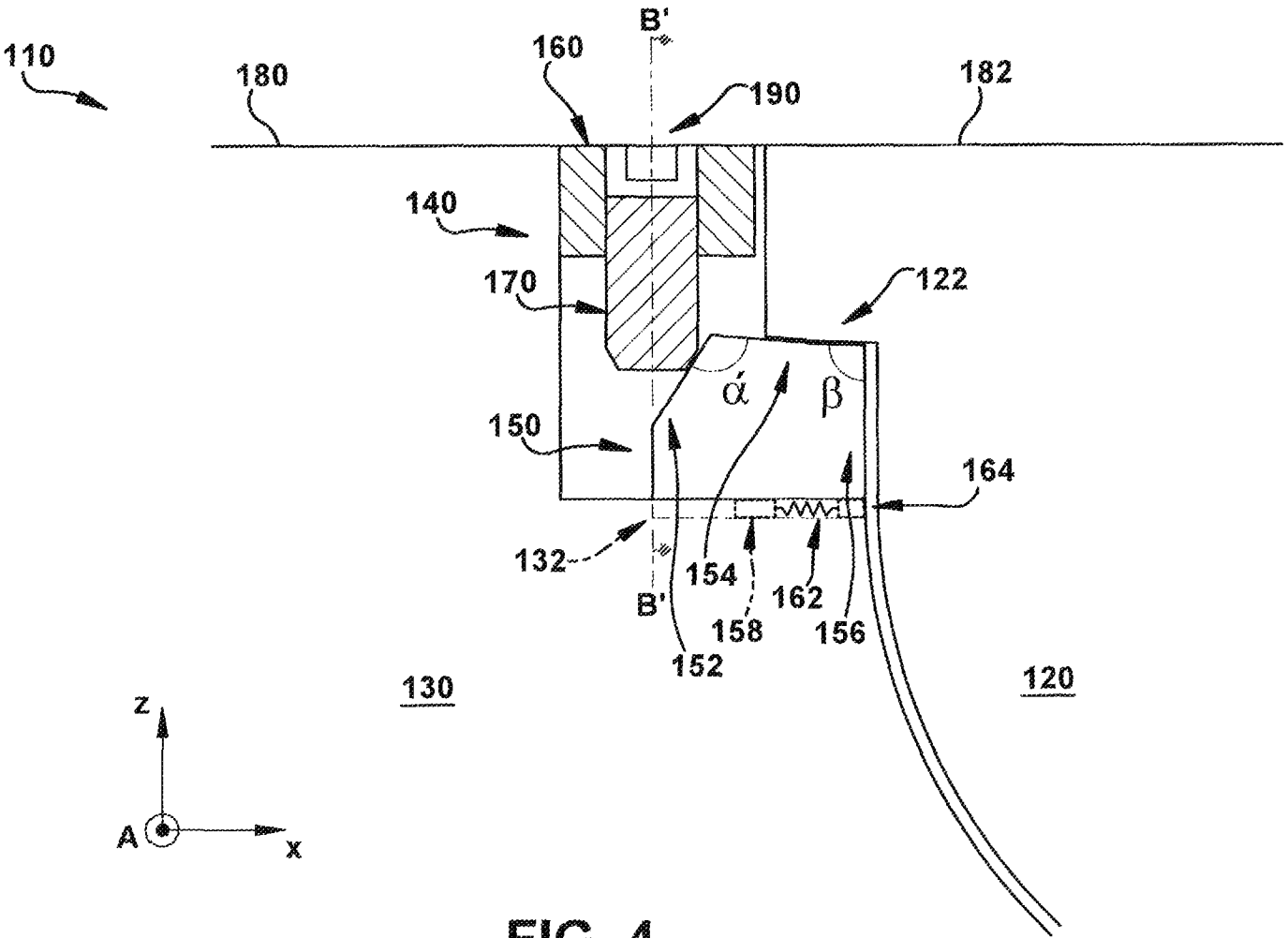
FIG. 4 shows a partial end elevation of a steam turbine apparatus according to an embodiment of the invention.

Turning to FIG. 4, a steam turbine apparatus 110 is shown according to an embodiment. As used herein, the directional key in the lower left-hand portion of FIGS. 4-6 and 8 is provided for ease of reference. As shown, this key is oriented with respect to the close-up views of portions of steam turbine apparatuses described herein. For example, as used in FIGS. 4-6 and 8, the "z" axis represents vertical (or radial) orientation, "x" represents horizontal (or radial) orientation, and the "A" axis represents axial orientation (along the axis of the turbine rotor, omitted for clarity).

As shown in FIG. 4, steam turbine apparatus 110 may include a casing segment 130, and a diaphragm segment 120 at least partially housed within casing segment 130. Also shown in FIG. 4 is an adjustable support apparatus 140 located between casing segment 130 and diaphragm segment 120. In one embodiment, adjustable support apparatus 140 may include a wedge member 150 contacting casing segment 130 and diaphragm segment 120, a support member 160, and an adjustment member 170 in contact with wedge member 150 and support member 160. As shown, casing segment 130 has a horizontal joint surface 180, and diaphragm segment 120 has a horizontal joint surface 182. In one embodiment, adjustment member 170 may be adjustable from a location (e.g., location 190) above one or both horizontal joint surfaces 180, 182. For example, where adjustment member 170 includes one or more of a pin, screw, bolt, bar, rod, etc. and support member 160 includes an aperture for receiving the adjustment member 170, an operator (e.g., human operator, robotic mechanism, controller, etc.) may be able to adjust a position of adjustment member 170 from location 190 above horizontal joint surface(s) 180, 182. In one embodiment, adjustment member 170 may be adjusted in the vertical (z-axis) direction. In another embodiment, adjustment member 170 may be adjusted in a direction other than the vertical (z-axis) direction, such as diagonally in the z-x direction or diagonally in the z-A direction. In any case, adjustment member 170 may be configured to adjust a position of wedge member 150 via an applied mechanical force. For example, in one embodiment, adjustment member 170 is configured to move downward in the vertical (z-axis) direction, and apply a mechanical force to wedge member 150 at a first angled face 152 of wedge member 150. First angled face 152 of wedge member 150 may be oriented at an obtuse (greater than 90 degrees) angle (alpha, $\acute{\alpha}$) relative to a second angled face 154. For example, in one embodiment, angle alpha ($\acute{\alpha}$) is greater than approximately 90 degrees and less than approximately 180 degrees. Second angled face 154 may be oriented at an obtuse (greater than 90 degrees) angle (beta, $\beta$) relative to a third face 156 of wedge member 150 (where third face 156 faces a portion of diaphragm segment 120). For example, in one embodiment, angle beta ($\beta$) is greater than approximately 90 degrees and less than approximately 180 degrees. Due to the angle ($\acute{\alpha}$) of first angled face 152, the downward force (z-direction) applied from adjustment member 170 is transmitted in part as a horizontal force (x-direction) on wedge member 150. This horizontal component of the downward force (horizontal force) may propel wedge member 150 toward diaphragm segment 120. This horizontal force may subsequently be transmitted from wedge member 150 to diaphragm segment 120 at second angled face 154 of wedge member 150. Specifically, a portion of this horizontal force may be transmitted from wedge member 150 to diaphragm segment 120 as a force parallel to the interface between second angled face 154 of wedge member 150 and an angled ledge 122 of diaphragm segment 120. That is, a portion of the downward force applied by adjustment member 170 to wedge member 150 is subsequently transmitted as a force parallel to the sliding surface between 122 and 154. This force may allow for adjustment (upwardly in the z direction) of the position of horizontal joint surface 182 of diaphragm segment 120 relative to horizontal joint surface 180 of casing segment 130. Conversely, movement of adjustment member 170 in the vertical (upward z-direction) direction, may reduce the force applied by adjustment member 170 on wedge member 150, allowing the weight of diaphragm segment 120 to force wedge member 150 radially outward (in x direction). This may allow for adjustment (downwardly in the z direction) of the position of horizontal joint surface 182 of diaphragm segment 120 relative to horizontal joint surface 180 of casing segment 130.

In another embodiment, diaphragm segment 120 can be lifted manually upward (e.g., by a human operator), support member 160 may be removed, and wedge block 150 may be manually manipulated (e.g., by a human operator) to a desired position. This may allow for manual adjustment (downwardly in the z direction) of the position of horizontal joint surface 182 of diaphragm segment 120 relative to horizontal joint surface 180 of casing segment 130.

In an alternate embodiment, shown in FIG. 4 in phantom, a channel (e.g., a key way) 132 may be formed in casing 130 for receiving a protruding member (e.g., a key, a pin, a dowel, a rib, etc.) 158 attached to wedge member 150 and a compressed elastic member (e.g., a spring or compressed elastic material) 162 coupled to protruding member 158. Protruding member 158 may be contiguous with wedge member 150, as in the case where protruding member 158 is machined from a portion of wedge member 150. Protruding member 158 may also be a separate component such as a key, pin, or dowel. In any case, compressed elastic member 162 may be attached to protruding member 158 (e.g., via a weld, clamp, etc.) and may contact a second protruding member 164 attached to (or contiguous with) casing 130, providing a radially outward (x-direction) force on protruding member 158 (in the negative x-direction). Second protruding member 164 may be substantially similar to protruding member 158, however, second protruding member 164 is attached to (or contiguous with) casing 130 (and not wedge member 150). When the force applied downwardly by adjustment member 170 is reduced (e.g., by moving adjustment member upwardly (in the z-direction), the force of compressed elastic member 162 on protruding member 158 may be substantial enough to force wedge member 150 radially outward (in x direction). This may allow for adjustment (downwardly in the z direction) of the position of horizontal joint surface 182 of diaphragm segment 120 relative to horizontal joint surface 180 of casing segment 130.

As described herein, in one embodiment, adjustment member 170 is configured to adjust the position of wedge member 150 in a direction substantially distinct from a direction of adjustment of adjustment member 170. For example, where adjustment member 170 is configured to adjust in a substantially vertical (z-axis) direction, wedge member 150 may be configured to move in a substantially horizontal (x-axis) direction. In one embodiment, angled ledge 122 of diaphragm segment 120 may be substantially complementary to angled face 154 of wedge member 150. It is understood that as used herein, the term "complementary" refers to a relationship between surfaces in which portions of those surfaces may be arranged substantially aligned with one another. For example, in one embodiment, portions of angled face 154 of wedge member 150 in contact with angled ledge 122 of diaphragm segment 120 may be substantially flush with one another (having little to no space there between). Additionally, it is understood that in one embodiment, angled ledge 122 may have a substantially similar angle as the angle between angled face 154 and face 156 (angle beta, β).

In any case, adjustment of the position of horizontal joint surface 182 of diaphragm segment 120 relative to horizontal joint surface 180 of casing segment 130 may be actuated by operating adjustment member 170. As described herein, adjustment member 170 may be accessible (e.g., by a human operator, robotic component, or other control mechanism) from a location 190 above horizontal joint surface(s) 180, 182. For example, adjustment member 170 may be a bolt with a bolt head, or a screw with a screw head. In this case, a human operator (with or without the aid of a wrench or other tool) may adjust a position of the bolt or screw by applying a downward or upward (and/or torsional) force on the bolt-head or screw-head. This human operator may access the bolt-head or screw-head from location 190 above horizontal joint surface(s) 180, 192. In one embodiment, support member 160 may have an aperture extending therethrough, and adjustment member 170 may be configured to move through the aperture to adjust a position of wedge member 150. For example, in one embodiment, support member 160 may have an internally threaded aperture extending therethrough, and adjustment member 170 may be a threaded screw with a screw-head as described herein. In this case, applying a rotational force on the screw head may allow for adjustment of adjustment member 170 in either an upward (positive z) direction or a downward (negative z) direction. Adjustment member 170 may include a metal having a composition such as Chromium-Molybdenum-Vanadium (CrMoV), a chromium stainless steel (e.g., Cr 422 SS), and/or a composite material such as fiber reinforced plastic (FRP). Adjustment member 170 may have a diameter of approximately 0.25 inches to approximately 2 inches and may have a length of approximately 2 inches to approximately 4 inches. Wedge member 150 may include a metal having a composition such as Chromium-Molybdenum-Vanadium (CrMoV), a chromium stainless steel (e.g., Cr 422 SS), and/or a composite material such as FRP. Wedge member 150 may be a substantially unitary structure (e.g., having no apertures extending therethrough), or alternatively, wedge member 150 may include a rigid frame or skeleton structure with one or more apertures extending therethrough. In one embodiment, wedge member 150 may include a plurality of subcomponents including, e.g., square-shaped objects, triangular-shaped objects, parallelogram-shaped objects, objects including arced or curved edges. These subcomponents may be formed of substantially similar materials, or in other embodiments, may be formed of substantially dissimilar materials. For example, in one embodiment, distinct surfaces (e.g., first angled face 152, second angled face 154, and/or face 156) of wedge member 150 may include distinct materials, which may allow for improved interaction between those surfaces and other surfaces in steam turbine apparatuses 110, 210. For example, in one embodiment, first angled face 152 and second angled face 154 may include distinct materials, where first angled face 152 interacts with adjustment member 170 and second angled face 154 interacts with angled ledge 122. In one embodiment, first angled face 152, second angled face 154 and/or angled ledge 122 may be coated (e.g., with titanium carbonitride (TiCN), titanium nitride (TiN), etc.) to reduce friction between contacting surfaces (faces, ledges).

In an embodiment, adjustable support apparatus 140 may be unaffixed (e.g., not fastened) to diaphragm segment 120. This may allow for reduced machining on the diaphragm segment 120 as compared with the support bars of the prior art (e.g., in FIG. 3). That is, adjustable support apparatus 140 may reduce the need to drill or otherwise form apertures in diaphragm segment 120 for receiving bolts or screws coupling a support bar thereto.

Figure 5:
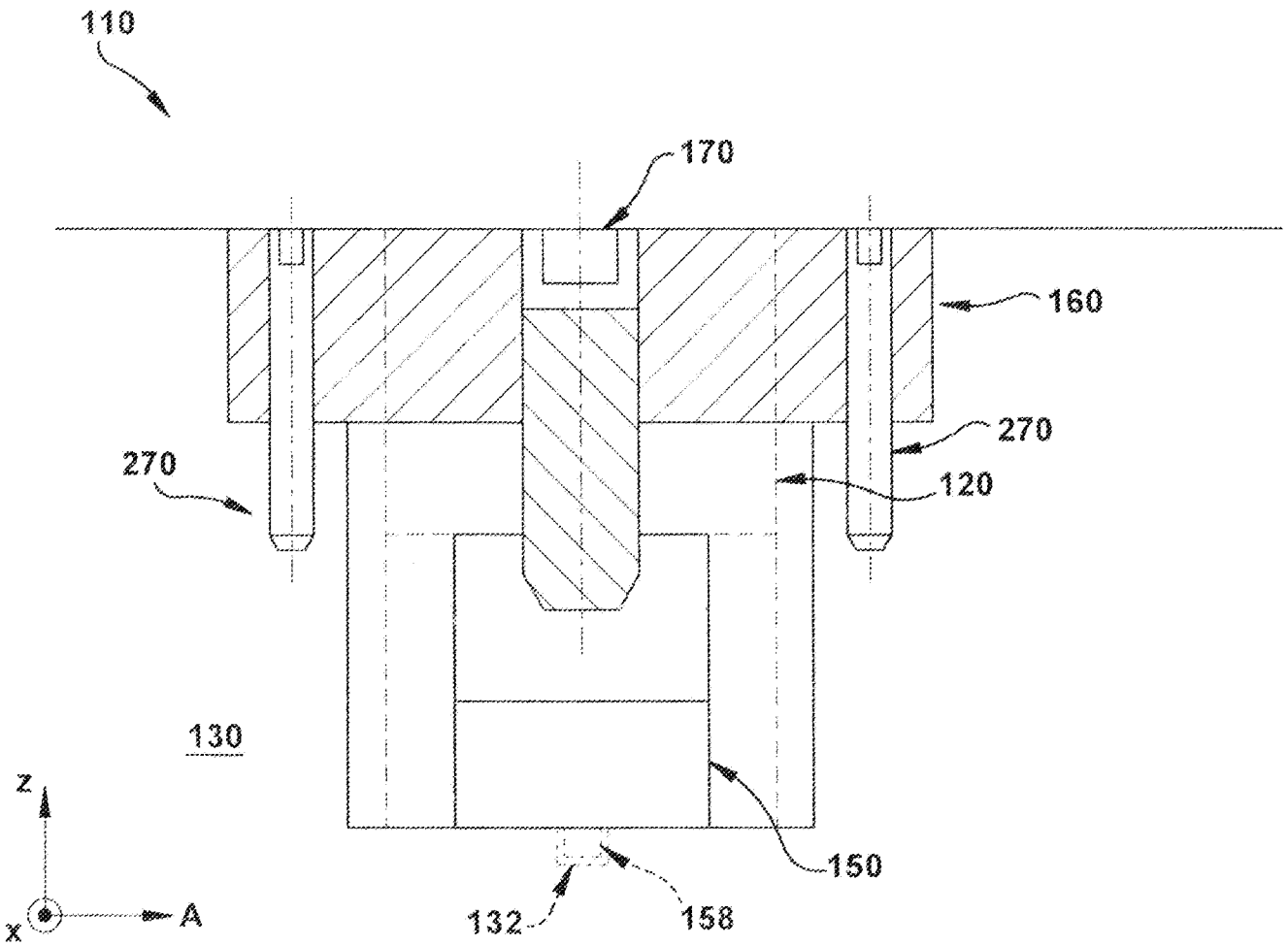
FIG. 5 shows a partial side elevation of a steam turbine apparatus taken along the line B-B' of FIG. 4 according to an embodiment of the invention.

Turning to FIG. 5, a side view of a portion of the steam turbine apparatus 110 is shown. As shown in FIG. 5, in one embodiment, support member 160 may be affixedly coupled to casing segment 130 by, e.g., one or more fasteners 270. Fastener(s) 270 may be any conventional component configured to couple support member 160 to casing segment 130. For example, fastener 270 may be a bolt, pin, rod, etc. In one embodiment, use of fastener 270 may require machining into casing segment 130 by, e.g., drilling to form apertures for receiving fastener 270. In one embodiment, fastener 270 may have a length (in the z direction) of approximately 1 inch to approximately 2 inches.

Figure 7:
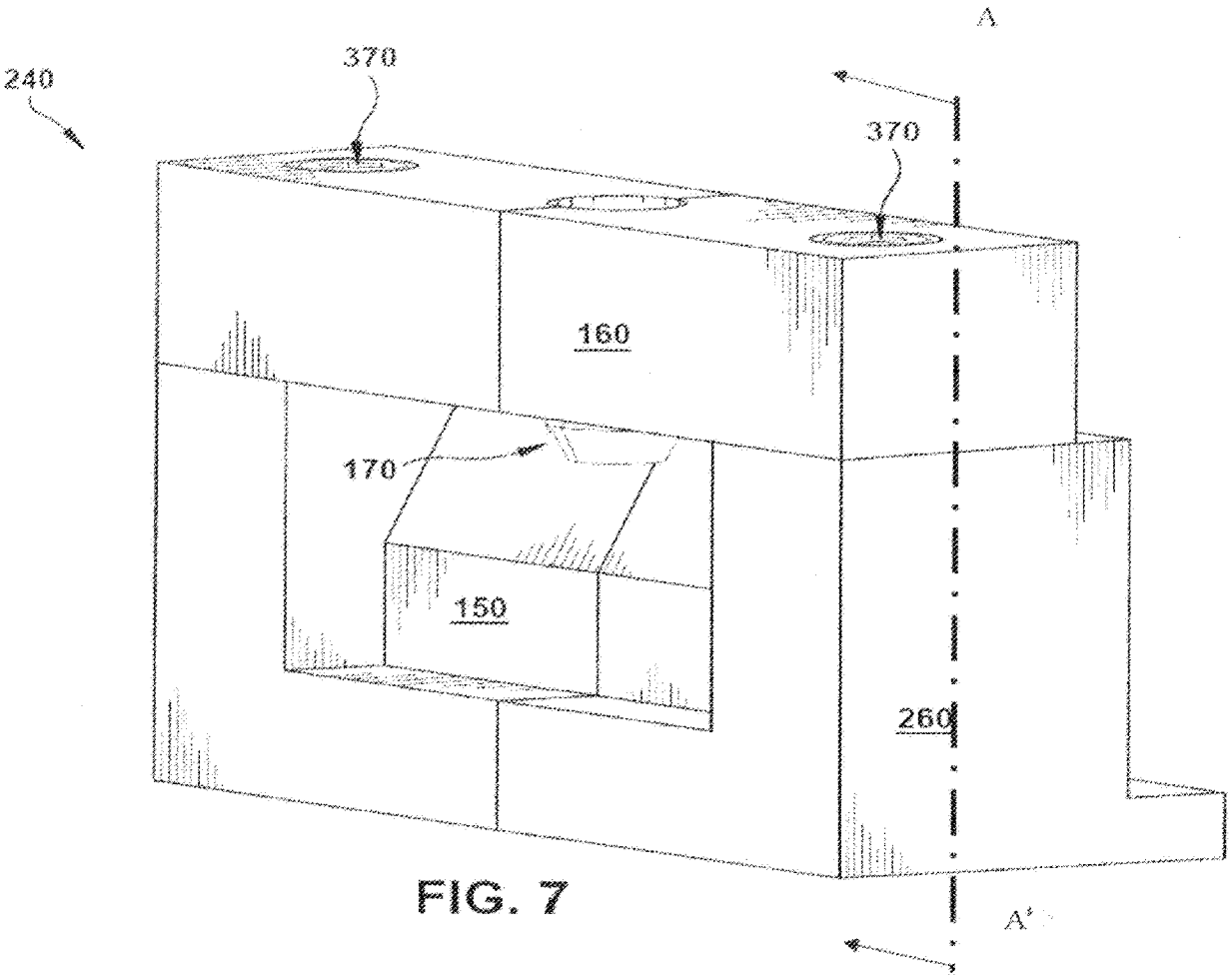
FIG. 7 shows a three-dimensional perspective view of a partial end elevation of an adjustable support apparatus according to an embodiment of the invention.

Turning to FIG. 6, a partial cut-away view of a steam turbine apparatus 210 including an adjustable support apparatus 240 is shown according to an embodiment. As shown, steam turbine apparatus 210 and adjustable support apparatus 240 may include components shown and described with reference to steam turbine apparatus 110 and adjustable support apparatus 140 of FIGS. 4-5. However, adjustable support apparatus 240 may further include a wedge member housing 260 at least partially supporting wedge member 150. Wedge member housing 260 may be formed of any material configured to support wedge member 150, and may allow for reduced machining of casing segment 130 as compared to steam turbine apparatus 110 of FIGS. 4-5. That is, wedge member housing 260 may allow support member 160 and adjustment member 170 to adjust a position of wedge member 150 without affixedly coupling support member 160 to casing segment 130. As is illustrated in FIG. 7, adjustable support apparatus 240 may include wedge member housing 260 affixedly coupled to support member 160. Wedge member housing 260 and support member 160 may be affixedly coupled via fasteners 370 (e.g., one or more bolts, screws, pins, etc). Embodiments using wedge member housing 260 may allow for reduced machining of casing segment 130, as fastener(s) 270 (FIG. 5) are not necessary to affixedly couple support member 160 directly to casing segment 130.

Figure 8:
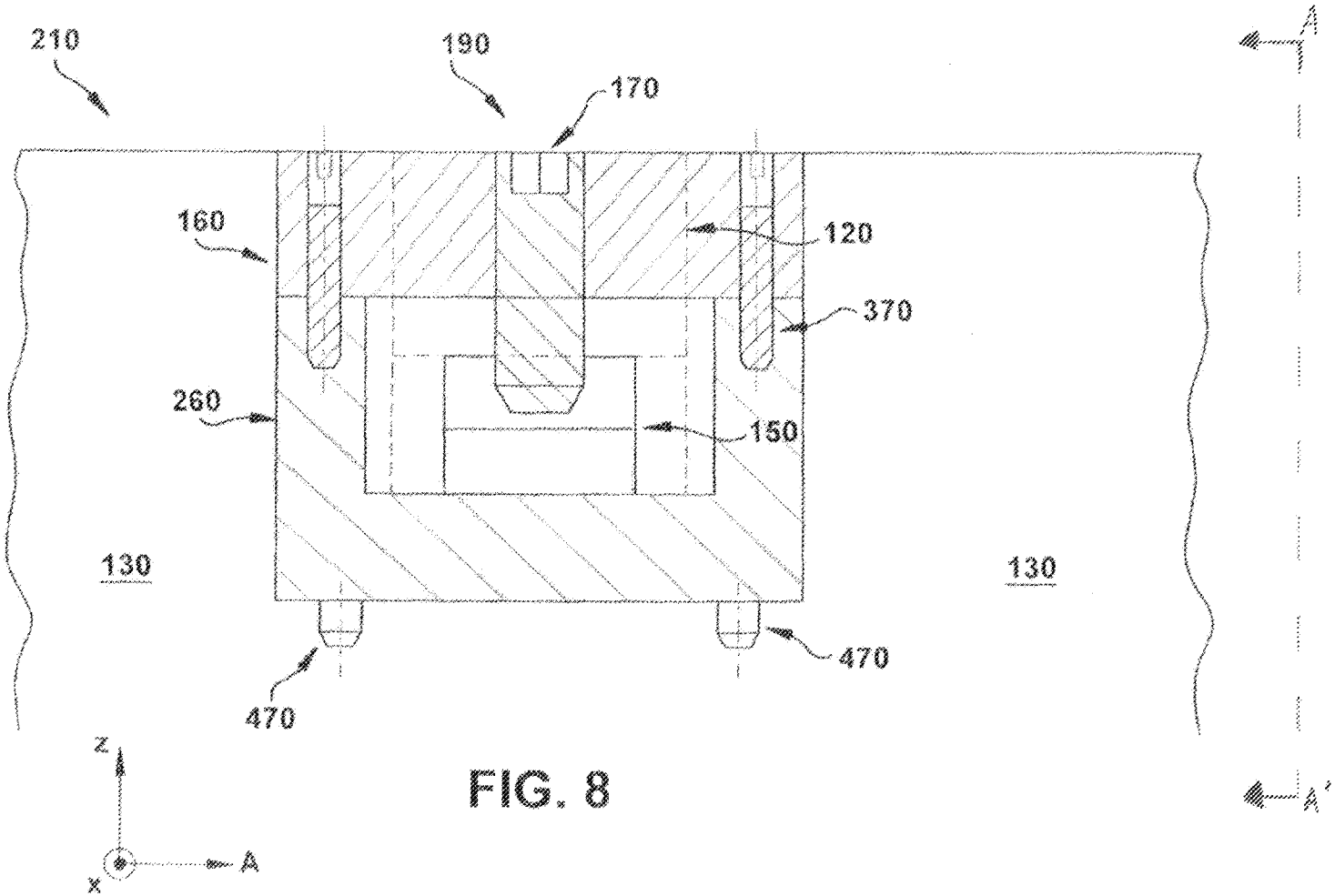
FIG. 8 shows a partial side elevation of a steam turbine apparatus according to an embodiment of the invention.

The distinction between adjustable support apparatus 240 (FIGS. 6-7) and adjustable support apparatus 140 (FIGS. 4-5) is further illustrated in FIG. 8, which shows a side partial cross-sectional view of steam turbine apparatus 210 including adjustable support apparatus 240. As shown, support member 160 may be affixedly coupled to wedge member housing 260 (via, e.g., fastener(s) 370). However, support member 160 is not directly coupled to casing segment 130. In one embodiment, wedge member housing 260 may be affixedly coupled to casing segment 130. For example, wedge member housing 260 may be separately affixedly coupled to casing segment 130 by fasteners 470. In one embodiment, fasteners 470 may be dowels formed of any material capable of affixedly coupling wedge member housing 260 and casing segment 130. In another embodiment, fasteners 470 may be bolts, screws, etc. In the case that fastener 470 includes a dowel, minimal machining of casing segment 130 may be required. As is known in the art, dowels may be sized to fit into small (short) complementary apertures. In one embodiment, dowels may have a length (in the z direction) of approximately 0.5 inches to approximately 1 inch. In this case, complementary apertures machined into casing segment 130 may be approximately 0.667 inches to approximately 1.1 inches deep. In any case, adjustable support apparatus 240 may allow for adjustment of a position of wedge member 150 from a location 190 above horizontal joint surface(s) 180, 182 (e.g., by access to, and manipulation of a position of a bolt-head, screw-head or end portion of adjustment member 170). Further, as with adjustable support apparatus 140 (FIGS. 4-5), adjustable support apparatus 240 may reduce the need to drill or otherwise form apertures in diaphragm segment 120 for receiving bolts or screws coupling a support bar thereto.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A steam turbine apparatus comprising:
- a casing segment;
- a diaphragm segment at least partially housed within the casing segment; and
- an adjustable support apparatus between the casing segment and the diaphragm segment, the adjustable support apparatus including:
  - a wedge member contacting the casing segment and the diaphragm segment;
  - a support member; and
  - an adjustment member in contact with the wedge member and the support member,
  - wherein the adjustment member is configured to adjust a position of the wedge member in a direction substantially distinct from a direction of adjustment of the adjustment member.

2. The steam turbine apparatus of claim 1, wherein casing segment has a horizontal joint surface, and the adjustment member is adjustable from a location above the horizontal joint surface.

3. The steam turbine apparatus of claim 1, further comprising a wedge member housing at least partially supporting the wedge member, wherein the wedge member housing is affixedly coupled to the support member.

4. The steam turbine apparatus of claim 3, wherein the wedge member housing is further affixedly coupled to the casing segment.

5. The steam turbine apparatus of claim 1, wherein the wedge member has a first angled face in contact with the adjustment member and a second angled face distinct from the first angled face, the second angled face in contact with the diaphragm segment.

6. The steam turbine apparatus of claim 5, wherein the diaphragm segment includes a ledge for engaging the second angled face of the wedge member, the ledge being substantially complementary to the second angled face.

7. The steam turbine apparatus of claim 1, wherein the support member is affixedly coupled to the casing segment.

8. The steam turbine apparatus of claim 1, wherein the support member includes an aperture extending at least partially therethrough, and wherein the adjustment member is configured to move through the aperture to manipulate a position of the wedge member.

9. The steam turbine apparatus of claim 8, wherein the adjustment member includes at least one of: a pin, a bolt, a screw or a rod.

10. A steam turbine apparatus comprising:
- a casing having a horizontal joint surface;
- a rotor within the casing;
- a diaphragm segment at least partially housed within the casing; and an adjustable support apparatus between the casing and the diaphragm segment, the adjustable support apparatus including:

a wedge member contacting the casing and the diaphragm segment;

a support member having an aperture extending at least partially therethrough; and an adjustment member in contact with the wedge member and at least partially located within the aperture of the support member;

wherein the adjustment member is configured to adjust a position of the wedge member from a location above the horizontal joint surface, and wherein the adjustment member is configured to adjust the position of the wedge member in a direction substantially distinct from a direction of adjustment of the adjustment member.

11. The steam turbine apparatus of claim 10, further comprising at least one fastener affixing the support member to the casing.

12. The steam turbine apparatus of claim 10, further comprising a wedge member housing at least partially supporting the wedge member, the wedge member housing affixedly coupled to the support member and the casing.

13. The steam turbine apparatus of claim 12, wherein the wedge member housing is separately affixedly coupled to the support member and the casing.

14. A steam turbine apparatus comprising:

a diaphragm segment having a horizontal joint surface and an angled ledge below the horizontal joint surface, the angled ledge configured to receive a complementary angled portion of a wedge member;

a casing segment at least partially housing the diaphragm segment, wherein the wedge member partially supports the diaphragm segment at the angled ledge, and wherein the wedge member rests upon the casing segment or a wedge member housing; and an adjustment member in contact with the wedge member, the adjustment member configured to adjust a position of the wedge member and a position of the diaphragm segment from a location above the horizontal joint surface, wherein the adjustment member is configured to adjust the position of the wedge member in a direction substantially distinct from a direction of adjustment of the adjustment member.

15. The steam turbine apparatus of claim 14, further comprising a support member at least partially housing the adjustment member.

16. The steam turbine apparatus of claim 15, wherein the support member is removably affixed to one of the casing segment or the wedge member housing.

* * * * *